US011783760B2

(12) United States Patent
Wu et al.

(10) Patent No.: US 11,783,760 B2
(45) Date of Patent: Oct. 10, 2023

(54) PIXEL CIRCUIT AND DISPLAY PANEL

(71) Applicant: WUHAN CHINA STAR OPTOELECTRONICS SEMICONDUCTOR DISPLAY TECHNOLOGY CO., LTD., Hubei (CN)

(72) Inventors: Lei Wu, Hubei (CN); Mian Zeng, Hubei (CN); Liang Sun, Hubei (CN)

(73) Assignee: Wuhan China Star Optoelectronics Semiconductor Display Technology Co., Ltd., Hubei (CN)

( * ) Notice: Subject to any disclaimer, the term of this patent is extended or adjusted under 35 U.S.C. 154(b) by 34 days.

(21) Appl. No.: 17/614,511

(22) PCT Filed: Sep. 22, 2021

(86) PCT No.: PCT/CN2021/119594
§ 371 (c)(1),
(2) Date: Nov. 26, 2021

(87) PCT Pub. No.: WO2023/035321
PCT Pub. Date: Mar. 16, 2023

(65) Prior Publication Data

US 2023/0071459 A1 Mar. 9, 2023

(30) Foreign Application Priority Data

Sep. 9, 2021 (CN) ..... 202111056271.5

(51) Int. Cl.
*G09G 3/32* (2016.01)

(52) U.S. Cl.
CPC ..... *G09G 3/32* (2013.01); *G09G 2300/0426* (2013.01); *G09G 2300/0842* (2013.01);
(Continued)

(58) Field of Classification Search
CPC ..... G09G 2300/0842; G09G 3/32; G09G 2300/0426; G09G 2310/027; G09G 2310/0267
See application file for complete search history.

(56) References Cited

U.S. PATENT DOCUMENTS

2003/0142048 A1* 7/2003 Nishitani ..... G09G 3/3258 345/82
2005/0062106 A1* 3/2005 Noguchi ..... H01L 27/14601 257/347
(Continued)

FOREIGN PATENT DOCUMENTS

CN 1514426 A 7/2004
CN 101515433 A 8/2009
(Continued)

OTHER PUBLICATIONS

International Search Report in International application No. PCT/CN2021/119594,dated May 25, 2022.
(Continued)

*Primary Examiner* — Muhammad N Edun
(74) *Attorney, Agent, or Firm* — PV IP PC; Wei Te Chung; Zhigang Ma

(57) ABSTRACT

The present disclosure provides a pixel circuit and a display panel. The pixel circuit controls a conduction time of the driving module according to a connected triangle-wave analog signal, a time controlling analog signal, and a brightness control analog signal connected through an analog comparator, and controls a conduction degree of the driving module according to a brightness control analog signal connected through the analog comparator; thus a light-emitting time and/or luminous brightness of a light-emitting module is controlled, and multi-gray-scale display with a simpler pixel circuit structure is realized.

20 Claims, 13 Drawing Sheets

(52) U.S. Cl.
CPC ..... *G09G 2310/027* (2013.01); *G09G 2310/0267* (2013.01)

(56) References Cited

U.S. PATENT DOCUMENTS

| | | | | |
|---|---|---|---|---|
| 2010/0123649 | A1* | 5/2010 | Hamer | G09G 3/3225 345/76 |
| 2013/0099692 | A1* | 4/2013 | Chaji | G09G 3/3233 315/224 |
| 2022/0198995 | A1* | 6/2022 | Ahmed | H01L 27/1255 |

FOREIGN PATENT DOCUMENTS

| | | | |
|---|---|---|---|
| CN | 205920745 | U | 2/2017 |
| CN | 108924985 | A | 11/2018 |
| CN | 111028776 | A | 4/2020 |
| CN | 111243499 | A | 6/2020 |
| CN | 111462685 | A | 7/2020 |
| CN | 111489687 | A | 8/2020 |
| CN | 113096589 | A | 7/2021 |
| JP | S6365769 | A | 3/1988 |
| JP | H11221941 | A | 8/1999 |
| JP | 2002297097 | A | 10/2002 |
| KR | 20140005786 | A | 1/2014 |
| WO | 03052728 | A1 | 6/2003 |

OTHER PUBLICATIONS

Written Opinion of the International Search Authority in International application No. PCT/CN2021/119594,dated May 25, 2022.
Chinese Office Action issued in corresponding Chinese Patent Application No. 202111056271.5 dated Jul. 6, 2022, pp. 1-6.

* cited by examiner

PIXEL CIRCUIT AND DISPLAY PANEL

FIELD OF INVENTION

The present disclosure relates to a field of display technology, and particularly to a pixel circuit and a display panel.

BACKGROUND OF INVENTION

In a traditional technical solution, a pixel circuit includes many components, and a circuit structure is complicated. For example, the pixel circuit shown in FIG. 1 includes a transistor T1, a transistor T2, a transistor T3, a transistor T4, a transistor T5, a transistor T6, a transistor T7, a storage capacitor Cst, and a light-emitting device D1. One end of the storage capacitor Cst and one from a source and a drain of the transistor T5 are connected to a power source positive signal VDD; another from the source and the drain of the transistor T5 is electrically connected to one from a source and a drain of the transistor T1 and one from a source and a drain of the transistor T2; another from the source and the drain of the transistor T2 is connected to a data signal DATA; a gate of the transistor T2 is connected to a scan signal SCAN(N); another from the source and the drain of the transistor T1 is electrically connected to one from a source and a drain of the transistor T3 and one from a source and a drain of the transistor T6; both a gate of the transistor T6 and a gate of transistor T5 are connected to an emission control signal EM(N); another from the source and the drain of the transistor T6 is electrically connected to an anode of the light-emitting device D1 and one from a source and a drain of the transistor T7; a cathode of the light-emitting device D1 is connected a power source negative signal VSS; both a gate of the transistor T3 and a gate of the transistor T7 are connected the scan signal SCAN (N); a gate of the transistor T1 is connected to another end of the capacitor Cst, another from the source and the drain of the transistor T3, and one from a source and a drain of the transistor T4 is electrically connected and forms a node Q; a gate of the transistor T4 is connected the scan signal SCAN (N−1); and another from the source and the drain of the transistor T4 and another from the source and the drain of the transistor T7 are both connected to an initial signal VI.

As shown in FIG. 2, a working stage of the pixel circuit shown in FIG. 1 includes:

Reset stage T11: SCAN(N−1) is set to low level, the transistor T4 is turned on, and a gate potential of the transistor T1 is reset to a potential of the initial signal VI.

Compensation stage T12: SCAN(N) is set to low level, the transistor T2, the transistor T3, and the transistor T7 are turned on, and an anode potential of the light-emitting device D1 is reset to the potential of the initial signal VI. The data signal DATA sequentially passes through the transistor T2, the transistor T1, and the transistor T3 to charge the gate potential of the transistor T1 to VDATA-Vth, wherein VDATA is a potential of the data signal DATA, and Vth is a threshold voltage of the transistor T1.

Light-emitting stage T13: The light-emitting control signal EM(N) is set to low level, and the light-emitting device D1 emits light. At this time, the light-emitting current Id is as follows:

$$Id = \frac{1}{2} \times \mu_p \times Cox \times \frac{W}{L} \times (VDD - VDATA)^2$$

The above-mentioned pixel circuit can work in a pulse amplitude modulation (PAM) driving mode, and the light-emitting device D1 is able to at least select from an inorganic light-emitting element such as a red light-emitting diode, a green light-emitting diode, and a blue light-emitting diode as sub-pixels of a display panel. Sub-pixels can express different color scales through the pulse amplitude modulation driving mode. The color scale is grayscale or gradation.

However, as shown in FIG. 3, the left picture of FIG. 3 is a schematic diagram of a wavelength of the blue sub-pixel changing with a change of the light-emitting current, the middle picture in FIG. 3 is a schematic diagram of a wavelength of the green sub-pixel changing with a change of the light-emitting current, the right picture in FIG. 3 is a schematic diagram of a wavelength of the red sub-pixel changing with a change of the light-emitting current, wherein the abscissa in the left, middle or right picture represent density of light-emitting current, that is, a value of current flowing per square centimeter; the ordinate in the left, middle or right picture represent a wavelength of a corresponding sub-pixel, and a unit of the ordinate is nanometer. It can be seen that, in the above pixel circuit, not only will color scale change with an amplitude of the light-emitting current, but the wavelength will also change accordingly, and resulting in a decrease of a color reproducibility of an image.

Moreover, the above-mentioned pixel circuit includes many components (7 transistors 1 capacitor, 7T1C) and/or functional units, resulting in a circuit structure of the pixel circuit shown in FIG. 1 becoming complicated, and it needs to occupy more display area, which is not conducive to increasing pixel density.

SUMMARY

The present disclosure provides a pixel circuit and a display panel to simplify the circuit structure complexity of a pixel circuit for multi-gray level display.

To solve the above technical problems, the technical solutions provided by the disclosure as follows.

First, the disclosure provides a pixel circuit, comprising: a light emitting module, a driving module, and an analog comparator, the driving module is electrically connected to the light emitting module; an output end of the analog comparator is electrically connected to a control end of the driving module. The analog comparator controls a conduction time of the driving module according to a connected triangle-wave analog signal, a connected time controlling analog signal, and a brightness control analog signal, and controls conduction degree of the driving module according to the brightness control analog signal.

In some of the embodiments, the analog comparator comprises a first transistor, a second transistor and a first capacitor, an output electrode of the first transistor is electrically connected to a control end of the driving module, an input electrode of the first transistor is connected to a brightness control analog signal; an output electrode of the second transistor is electrically connected to a gate electrode of the first transistor, an input electrode of the second transistor is connected to a time controlling analog signal, and a gate electrode of the second transistor is connected to a control signal; one end of the first capacitor is connected to a triangle-wave analog signal, and the another end of the first capacitor is electrically connected to the output electrode of the second transistor.

In some of the embodiments, in one frame time, a conduction time of the second transistor is earlier than a conduction time of the first transistor, and conduction time state of the second transistor is in a different time period from conduction time of the first transistor.

In some of the embodiments, conduction time of the driving module is later than or equal to conduction time of the first transistor.

In some of the embodiments, the analog comparator further comprises a third transistor and a fourth transistor, an input electrode of the third transistor is connected to a constant voltage signal, and a gate electrode of the third transistor is connected to a reset signal RST, an output electrode of the three transistor is electrically connected to the output electrode of the second transistor; and a fourth transistor, an input electrode of the fourth transistor is electrically connected to the input electrode of the third transistor, and a gate electrode of the fourth transistor is electrically connected to a gate electrode of the third transistor, and an output electrode of the fourth transistor is electrically connected to the output electrode of the first transistor.

In some of the embodiments, the driving module comprises a driving transistor, a gate electrode of the driving transistor is electrically connected to the output electrode of the first transistor, and an input electrode of the driving transistor or the output electrode of the driving transistor is electrically connected to the light emitting module.

In some of the embodiments, the first transistor, the second transistor, the third transistor, the fourth transistor, the fifth transistor, and the driving transistor are all P-channel thin film transistors, the constant voltage signal is a constant voltage high potential signal during a light-emitting phase of the pixel circuit, and a potential of the triangle-wave analog signal linearly changes from a high potential to a low potential.

In some of the embodiments, the first transistor, the second transistor, the third transistor, the fourth transistor, the fifth transistor, and the driving transistor are all N-channel thin film transistors, the constant voltage signal is a constant voltage low potential signal, during a light-emitting phase of the pixel circuit, a potential of the triangle-wave analog signal linearly changes from a low potential to a high potential.

In some of the embodiments, at least one of a potential of the time controlling analog signal and a potential of the brightness control analog signal is kept constant.

In some of the embodiments, the pixel circuit further comprises a first wiring, a second wiring and a memory module, the first wiring is configured to transmit power source positive signal; the second wiring is configured to transmit power source negative signal; one end of the memory module is electrically connected to the control end of the driving module, and the another end of the storage module is electrically connected to the first wiring or the second wiring.

In some of the embodiments, the first wiring is electrically connected to the another end of the storage module and an input end of the driving module, an output end of the light emitting module is electrically connected to the input end of the driving module, and the output end of the light emitting module is electrically connected to the second wiring; or, the first wiring is electrically connected to an input end of the light emitting module, the output end of the light emitting module is electrically connected to the input end of the driving module, and the second wiring is electrically connected to the output end of the driving module and the another end of the storage module.

Second, the disclosure provides a display panel, the display panel includes at least a pixel circuit, and the pixel circuit is distributed in array on the display panel.

The pixel circuit and the display panel provided in present disclosure, the analog comparator controls conduction time of the driving module through a triangle-wave analog signal, a time controlling analog signal, and a brightness control analog signal, and then a light-emitting time of the light-emitting module is controlled. The analog comparator controls conduction degree of the driving module through a brightness control analog signal, and then a light-emitting brightness of the light-emitting module can be controlled, and by adjusting the light-emitting time and/or light-emitting brightness of the light-emitting module, multiple gray scales can be realized with a simpler pixel circuit structure.

DESCRIPTION OF DRAWINGS

In order to explain embodiments or technical solutions in the prior art more clearly, the following will briefly introduce drawings involved in a following description of the embodiments or the prior art. Obviously, the drawings in the following description are merely inventions. Those of ordinary skill in the art can obtain other drawings based on these drawings without creative work.

DETAILED DESCRIPTION OF EMBODIMENTS

In order to make the purpose, technical solutions, and effects of this application clearer, the following further describes this application in detail with reference to the accompanying drawings and examples. It should be understood that the specific embodiments described here are only used to explain the present application, and are not used to limit the present application.

Figure 1:
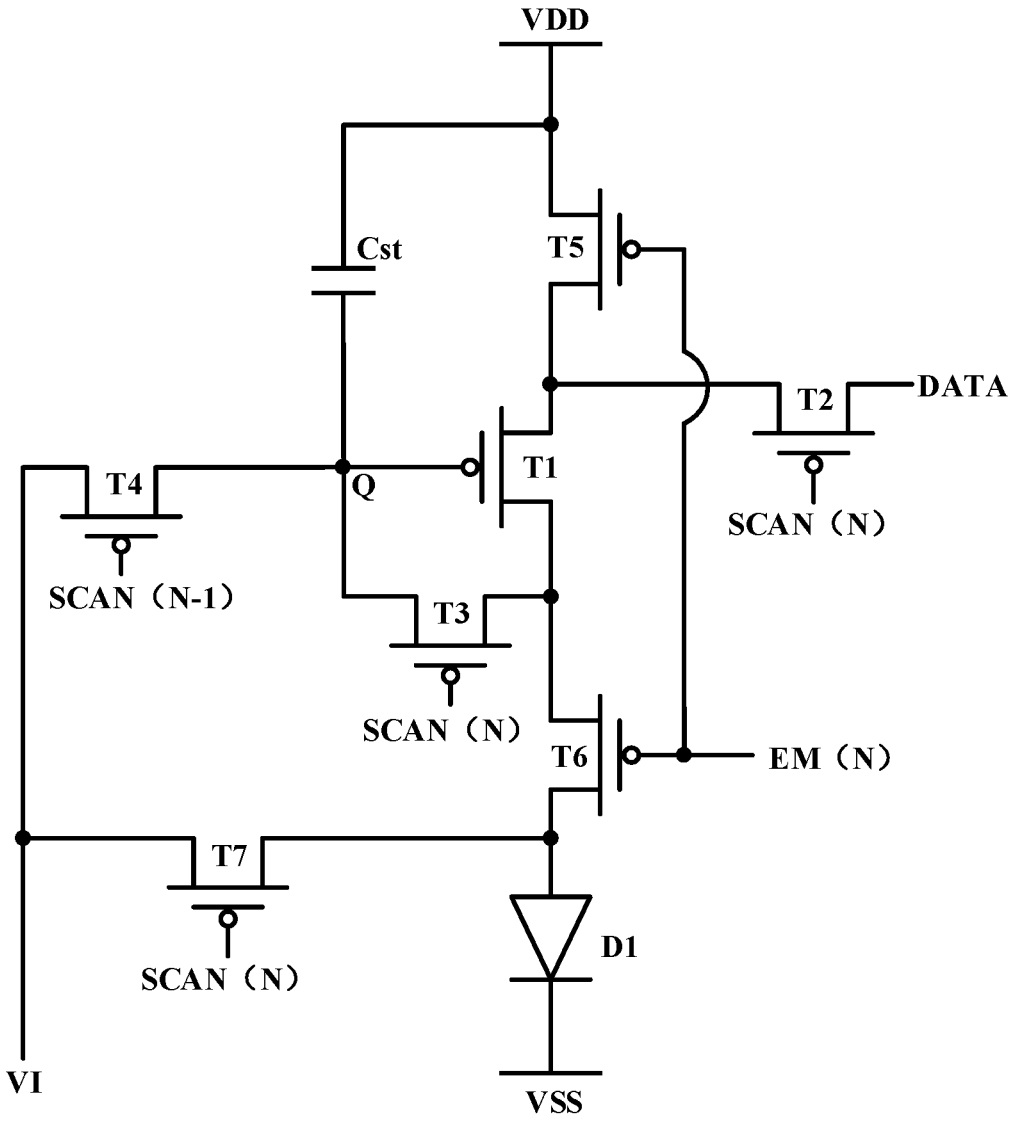
FIG. 1 is a schematic diagram of a pixel circuit provided by prior art.
Figure 2:
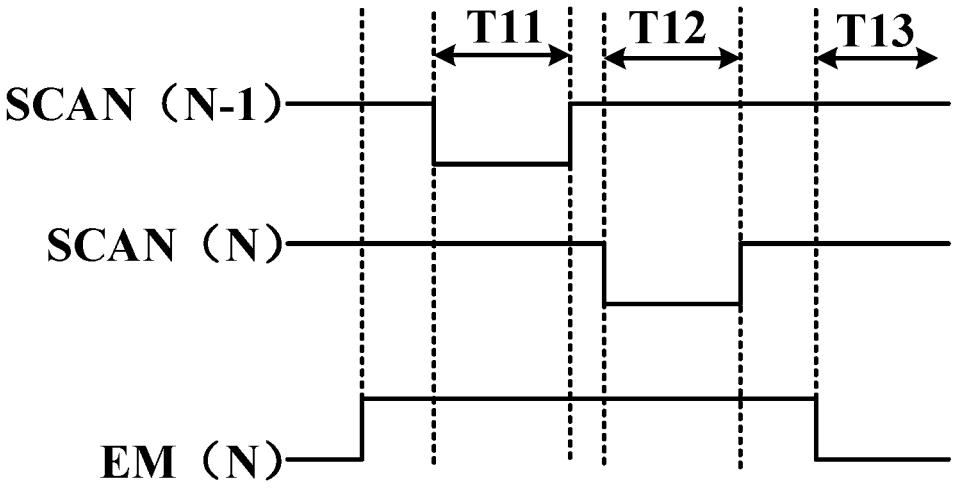
FIG. 2 is a timing diagram of the pixel circuit shown in FIG. 1.
Figure 3:
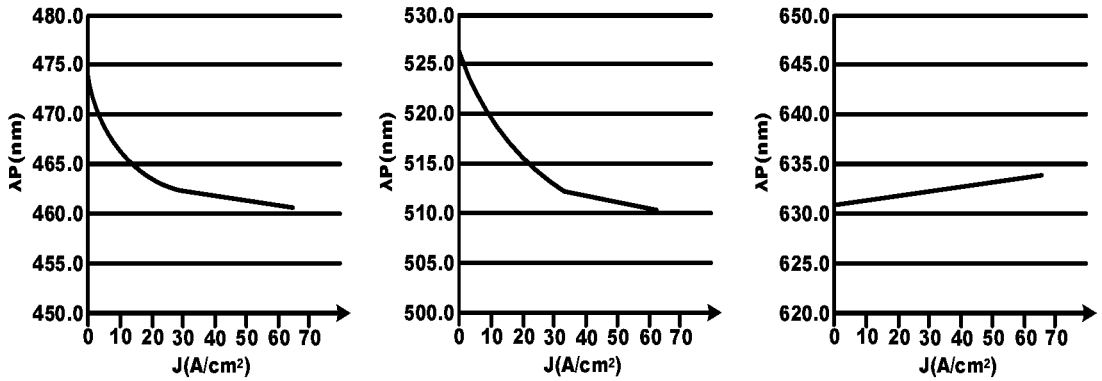
FIG. 3 is a schematic diagram of the relationship between wavelength and current at which the pixel circuit in FIG. 1 drives different pixels to emit light.
Figure 4:
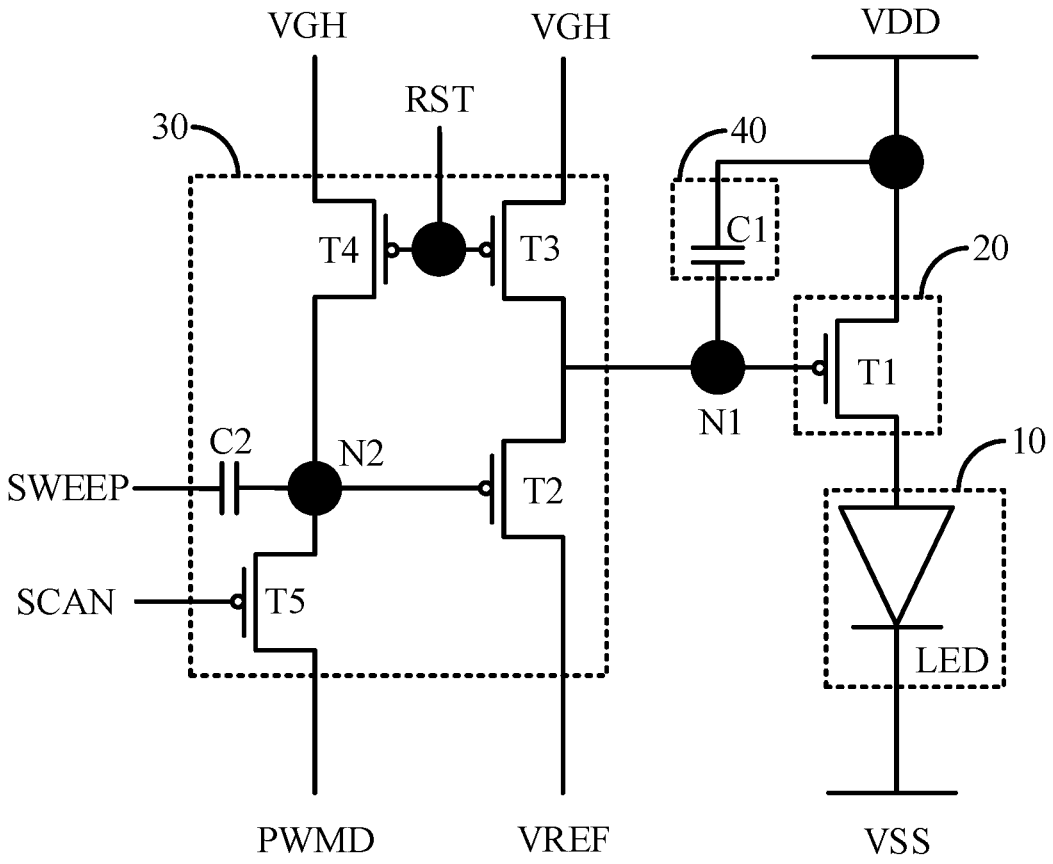
FIG. 4 is a schematic diagram of a first structure of a pixel circuit in one exemplary embodiment.
Figure 8:
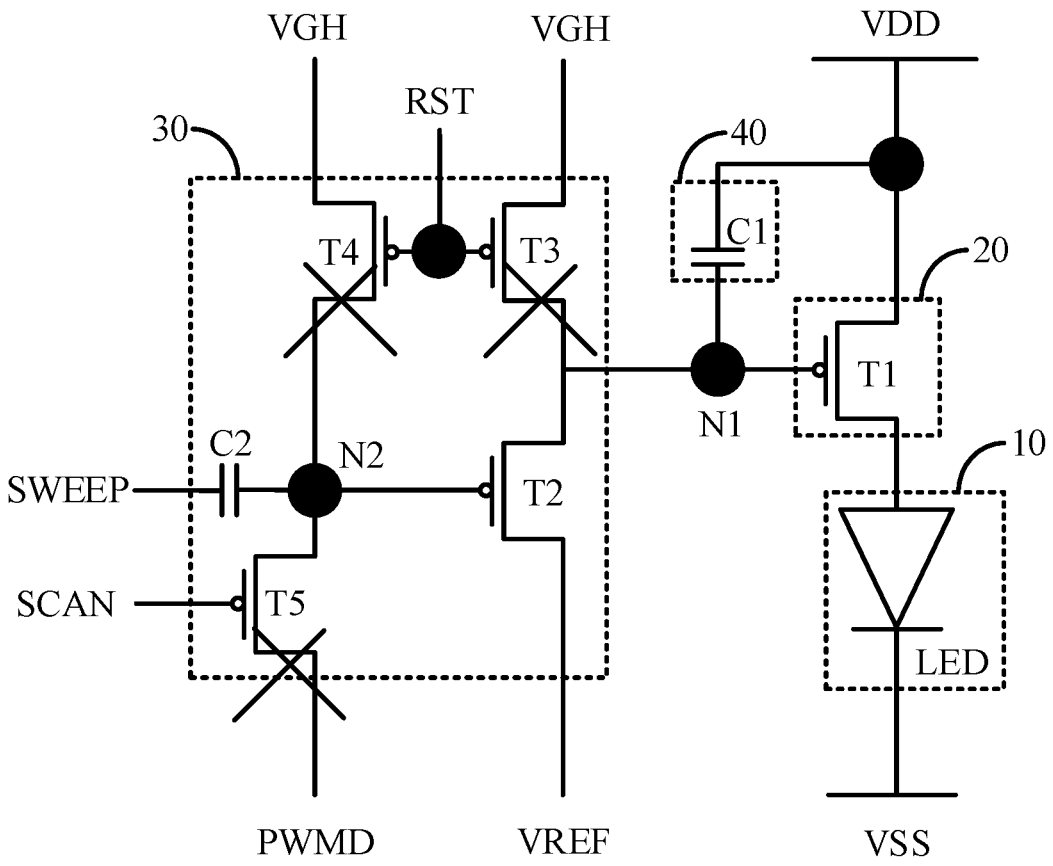
FIG. 8 is a schematic circuit diagram of the pixel circuit shown in FIG. 4 in a light-emitting stage.
Figure 9:
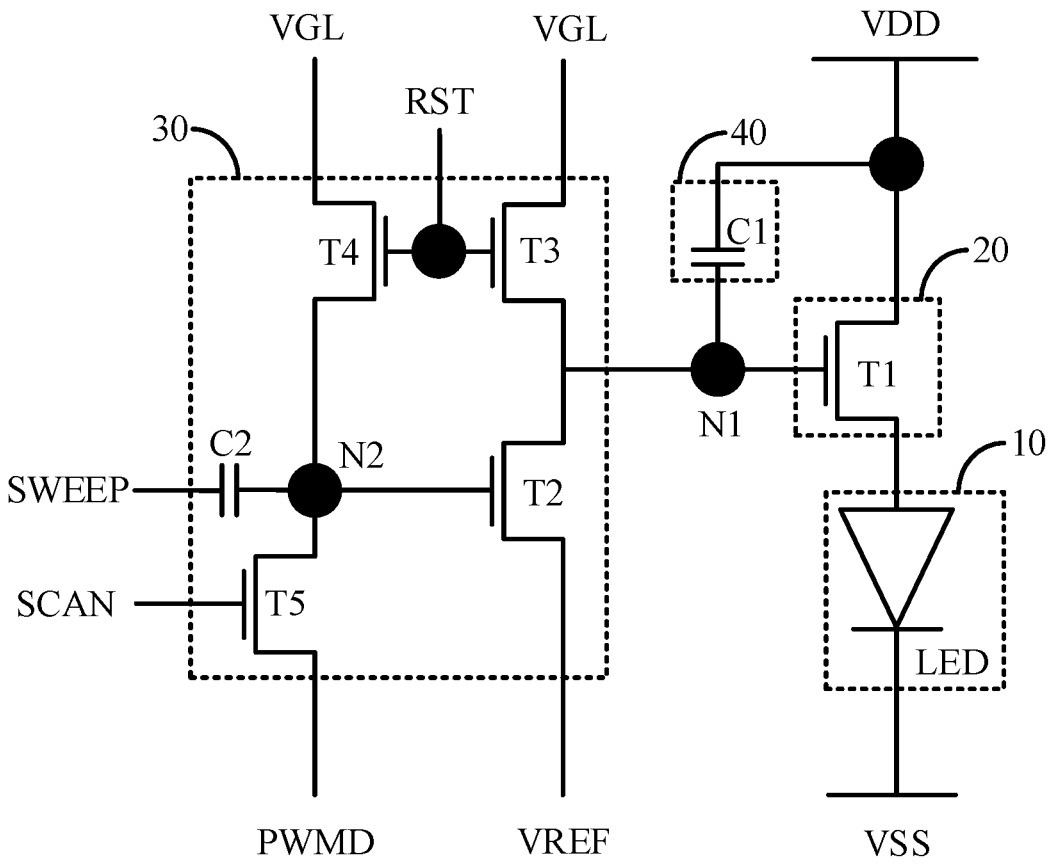
FIG. 9 is a schematic diagram of a second structure of a pixel circuit provided in one exemplary embodiment.

Based on some problems existing in the prior art shown in FIGS. 1 to 3, a pixel circuit is provided in this embodiment. Please refer to FIGS. 4 to 13, as shown in FIG. 4 or FIG. 9, the pixel circuit includes a light-emitting module 10, a driving module 20, and an analog comparator 30. The driving module 20 is electrically connected to the light emitting module 10; an output end of the analog comparator 30 is electrically connected to a control end of the driving module 20. The analog comparator 30 controls a conduction time of the driving module 20 according to a connected triangle-wave analog signal SWEEP, a time controlling analog signal PWMD and a brightness control analog signal VREF, and controls a conduction degree of the driving module 20 according to a brightness control analog signal VREF.

It can be understood that the pixel circuit provided in this embodiment controls the conduction time of the driving module 20 through the triangle-wave analog signal SWEEP, the time controlling analog signal PWMD, and the brightness control analog signal VREF, connected to the analog comparator 30, thereby a light-emitting time of the light-emitting module 10 is controlled. The conduction degree of the driving module 20 is controlled through the brightness control analog signal VREF connected to the analog comparator 30, thereby a brightness of the light-emitting module 10 is controlled, that is, by controlling the light-emitting time and/or luminous brightness, a multi-gray-scale display is realized through a simpler pixel circuit structure.

In one of the embodiments, the analog comparator 30 includes a first transistor T2, a second transistor T5, and a first capacitor C2. An output electrode of the first transistor T2 is electrically connected to a control end of the driving module 20. An input electrode of the first transistor T2 is connected to a brightness control analog signal VREF; an output electrode of the second transistor T5 is electrically connected to a gate electrode of the first transistor T2, an input electrode of the second transistor T5 is connected to a time controlling analog signal PWMD, and a gate electrode of the second transistor T5 is connected to a control signal; one end of the first capacitor C2 is connected to a triangle-wave analog signal SWEEP, and another end of the first capacitor C2 is electrically connected to the output electrode of the second transistor T5.

The input electrode can be one from the source electrode and the drain electrode, and the output electrode is the other from the source electrode and the drain electrode.

It is understandable that, in this embodiment, on-duration of the first transistor T2 can be controlled by modulating a slope of the triangle-wave analog signal SWEEP, and/or on-duration of the first transistor T2 can also be controlled by adjusting a potential of the time controlling analog signal PWMD. In this way, a light-emitting time of the light-emitting device LED is adjusted, and thus different gray-scale displays can be realized. Of course, the conduction time and/or conduction degree of the driving transistor T2 can also be controlled by adjusting the potential of the brightness control analog signal VREF, so that the light-emitting current flowing through the driving transistor T2 can be adjusted, and thus the gray-scale display can be changed.

In one of the embodiments, the analog comparator 30 further includes a third transistor T4 and a fourth transistor T3. An input electrode of the third transistor T4 is connected to a constant voltage signal, and a gate electrode of the third transistor T4 is connected to a reset signal RST. An output electrode of the three transistor T4 is electrically connected to the output electrode of the second transistor T5; an input electrode of the fourth transistor T3 is electrically connected to the input electrode of the third transistor T4, and a gate electrode of the fourth transistor T3 is electrically connected to the output electrode of a gate electrode of the third transistor T4, and an output electrode of the fourth transistor T3 is electrically connected to the output electrode of the first transistor T2.

It can be understood that, a potential of the first node N1 can be timely reset via the third transistor T4, and a potential of the second node N2 can be timely reset via the fourth transistor T3, thus, an accuracy of gray scale display is further improved.

In one of the embodiments, the driving module 20 includes a driving transistor T1, a gate electrode of the driving transistor T1 is electrically connected to the output electrode of the first transistor T2, and an input electrode of the driving transistor T1 or the output electrode of the driving transistor T1 is electrically connected to the light emitting module 10.

In one of the embodiments, the pixel circuit further includes a first wiring, a second wiring, and a memory module 40. The first wiring is configured to transmit a power source positive signal VDD; the second wiring is configured to transmit a negative power signal VSS; one end of the memory module 40 is electrically connected to the control end of the driving module 20, and another end of the memory module 40 is electrically connected to the first wiring or the second wiring.

In one of the embodiments, the memory module 40 includes a second capacitor C1. The second capacitor C1 is configured to store a potential of the brightness control analog signal VREF. One end of the second capacitor C1 is electrically connected to the gate electrode of the driving transistor T1, and another end of the second capacitor C1 is electrically connected to the first wiring or the second wiring.

As shown in FIG. 4, in one of the embodiments, the first wiring is electrically connected to another end of the memory module 40 and the input end of the driving module 20, and the input end of the light emitting module 10 is electrically connected to the input end of the driving module 20. The output end of the light-emitting module 10 is electrically connected to the second wiring.

As shown in FIG. 9, in one of the embodiments, the first wiring is electrically connected to the input end of the light emitting module 10, the output end of the light emitting module 10 is electrically connected to the input end of the driving module 20, and the second wiring is electrically connected to the output end of 20 and another end of the memory module 40.

In one of the embodiments, the light emitting module 10 may include a light emitting device LED, an anode of the light emitting device LED is able to electrically connect to the first wiring or an output electrode of the driving transistor T1, and the cathode of the light emitting device LED is able to electrically connect to the second wiring or the input electrode of driving transistor T1. The light-emitting device LED may be, but not limited to, an organic light-emitting diode (OLED), a Micro-LED, or a Mini-LED or other light-emitting diodes.

It should be noted that the input electrode is one from the source and the drain, and the output electrode is the other from the source and the drain.

As shown in FIG. 4, in one of the embodiments, the first transistor T2, the second transistor T5, the third transistor T4, the fourth transistor T3, the fifth transistor, and the driving transistor T1 are all P-channel thin film transistors. The constant voltage signal is a constant voltage high potential signal VGH. During a light-emitting phase of the pixel circuit, and a potential of the triangle-wave analog signal SWEEP linearly changes from a high potential to a low potential.

It should be noted that the constant voltage high potential signal VGH is able to turn on a corresponding N-channel thin film transistor.

Figure 5:
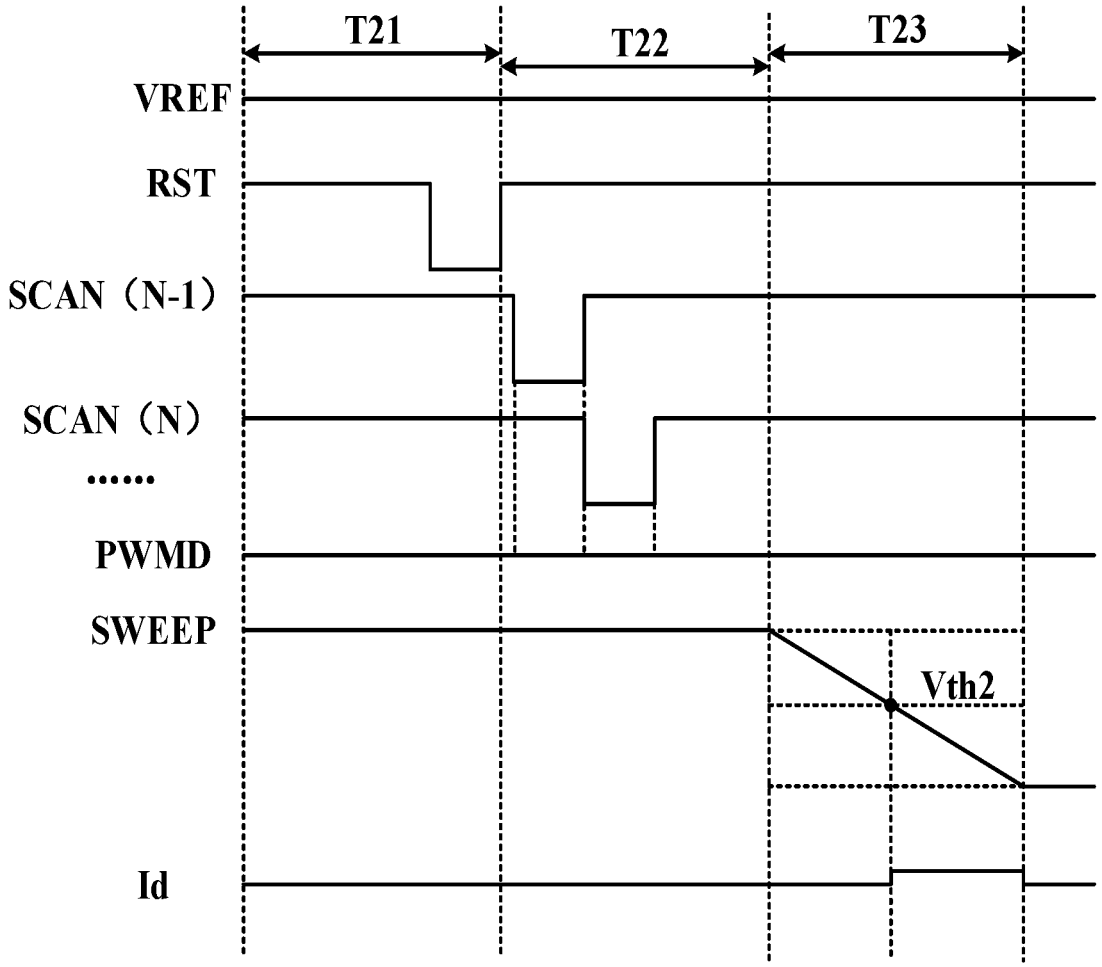
FIG. 5 is a timing diagram of the pixel circuit shown in FIG. 4.
Figure 6:
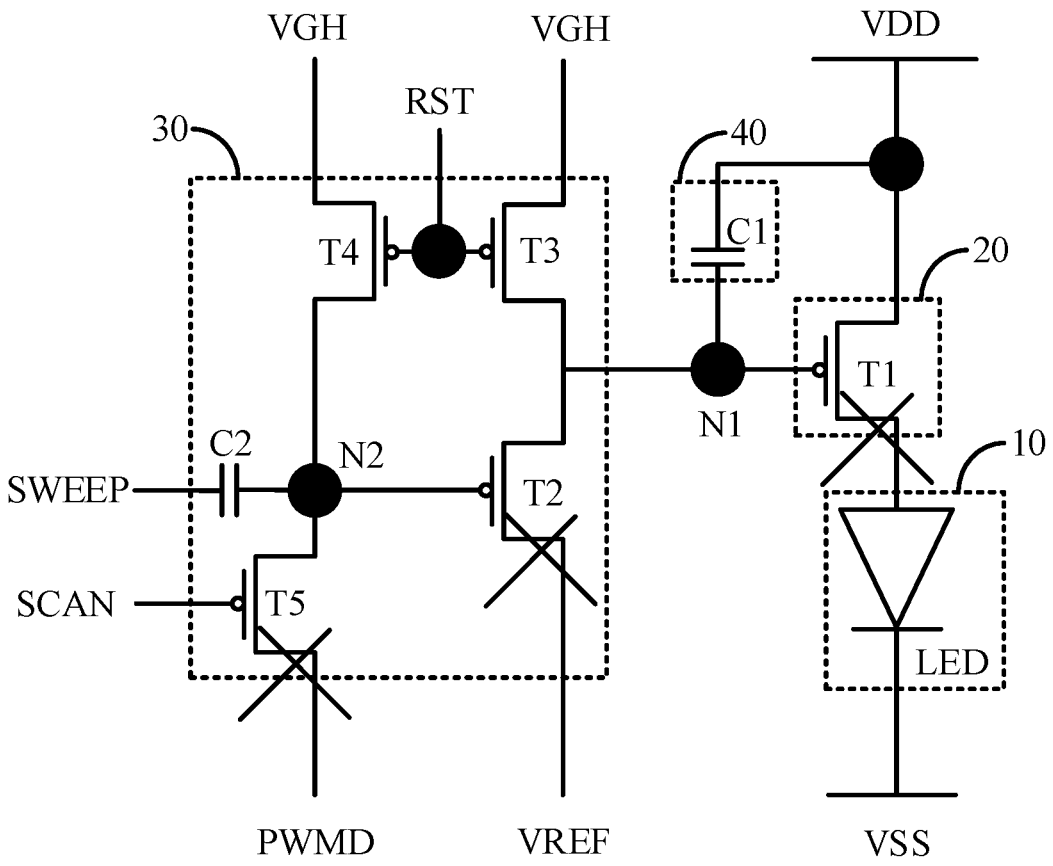
FIG. 6 is a circuit schematic diagram of the pixel circuit shown in FIG. 4 in a reset stage.

As shown in FIG. 5, a working stage of the pixel circuit shown in FIG. 4 includes:

Reset stage T21: As shown in FIG. 6, the reset signal RST is set at a low potential, the third transistor T4 and the fourth transistor T3 are both turned on, the second transistor T5 is turned off, both the potential of the first node N1 and the potential of the second node N2 is the potential of the constant voltage high-potential signal VGH. At this time, the first transistor T2 and the driving transistor T1 are both turned off, and the light-emitting device LED does not emit light.

Figure 7:
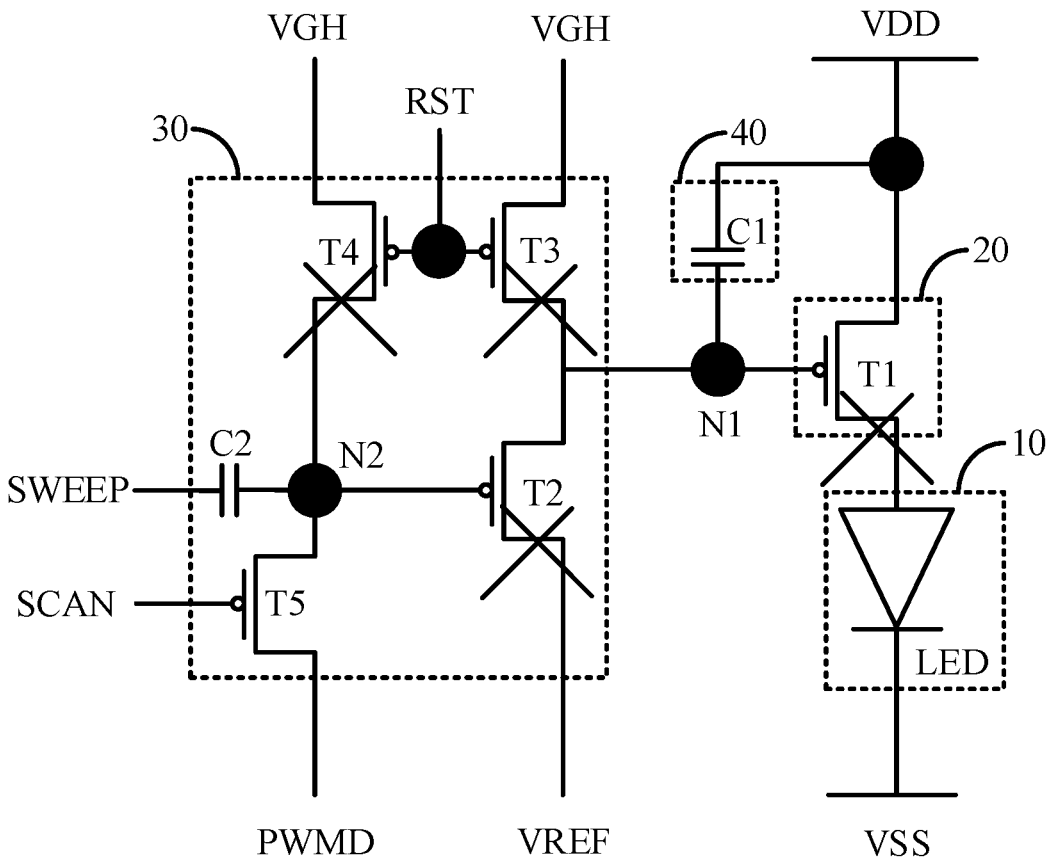
FIG. 7 is a circuit schematic diagram of the pixel circuit shown in FIG. 4 in a writing stage.

Row strobe stage T22: As shown in FIG. 7, the scan signal SCAN(N) is set at a low potential, the third transistor T4 and the fourth transistor T3 are both turned off, the second transistor T5 is turned on, and the potential of the second node N2 is the potential of the time controlling analog signal PWMD. At this time, the potential of the time controlling analog signal PWMD is greater than a difference between the potential of the constant voltage high potential signal VGH and the threshold voltage of the first transistor T2, the first transistor T2 is turned off, and the potential of the first node N1 remains the potential of the constant voltage high potential signal VGH, the driving transistor T1 is turned off, and the light-emitting device LED does not emit light. The scan signal SCAN (N−1) is a previous stage of the scan signal SCAN (N).

Light-emitting stage T23: As shown in FIG. 8, the potential of the triangle-wave analog signal SWEEP decreases linearly. At this time, the potential of the second node N2 also decreases linearly. When the potential of the second node N2 is less than a difference between the potential of the constant voltage high potential signal VGH and the threshold voltage of the first transistor T2, the first transistor T2 is turned on, the potential of the brightness control analog signal VREF is applied to the first node N1, the light-emitting device LED starts to emit light, and a light-emitting current Id of the light-emitting device LED is as follows:

$$Id = \frac{1}{2} \times \mu_p \times Cox \times \frac{W}{L} \times (VDD - VREF - Vth2)^2$$

In the above formula, VDD refers to a potential of the positive signal of the power supply, VREF refers to a potential of the brightness control analog signal, and Vth2 refers to a threshold voltage of the first transistor T2.

As shown in FIG. 9, in one of the embodiments, the first transistor T2, the second transistor T5, the third transistor T4, the fourth transistor T3, the fifth transistor, and the driving transistor T1 are all N-channel thin film transistors. The voltage signal is a constant voltage low potential signal VGL; and during the light-emitting phase of the pixel circuit, the potential of the triangle-wave analog signal SWEEP linearly changes from a low potential to a high potential.

It should be noted that, the constant voltage low potential signal VGL is able to turn on a corresponding P-channel thin film transistor.

Figure 10:
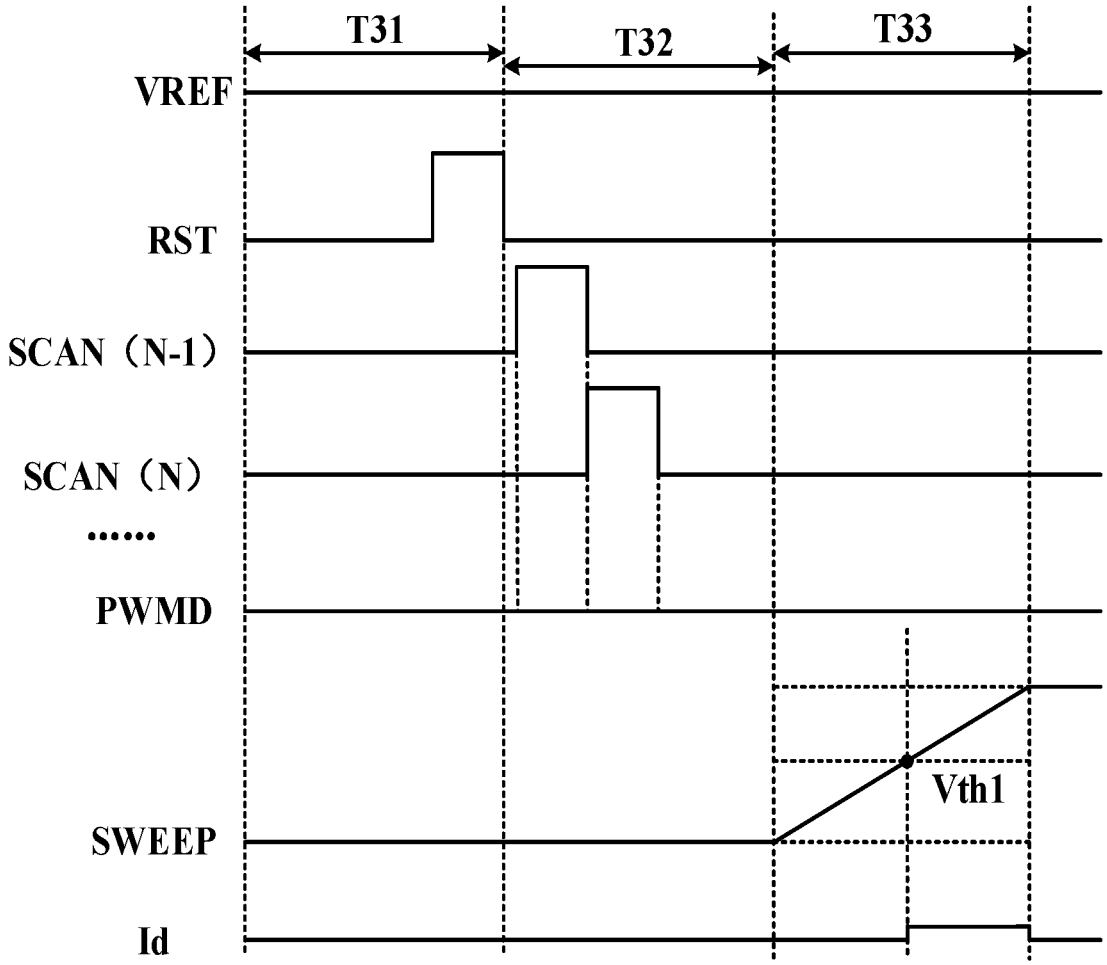
FIG. 10 is a timing diagram of the pixel circuit shown in FIG. 9.
Figure 11:
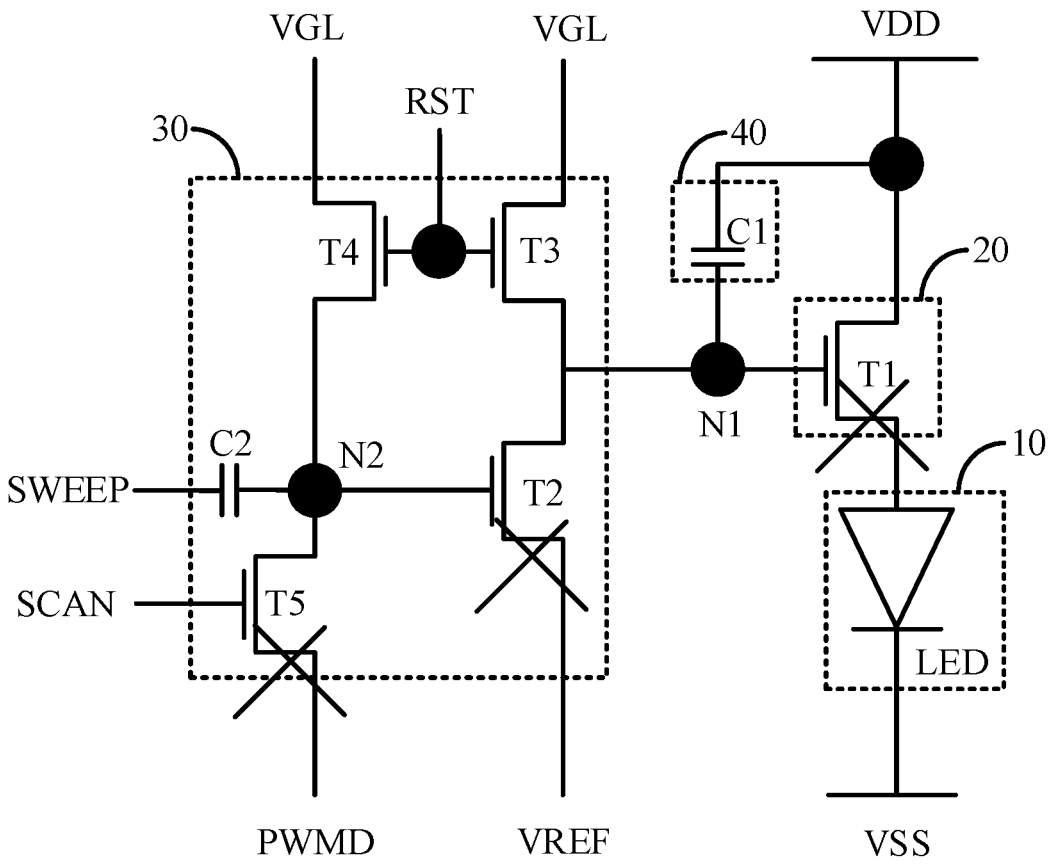
FIG. 11 is a circuit schematic diagram of the pixel circuit shown in FIG. 9 in a reset stage.

As shown in FIG. 10, the working stage of the pixel circuit shown in FIG. 9 includes:

Reset stage T31: As shown in FIG. 11, the reset signal RST is set to a high potential, the third transistor T4 and the fourth transistor T3 are both turned on, and the second transistor T5 is turned off. Both the potential of the first node N1 and the potential of the second node N2 is the potential of the constant voltage low potential signal VGL. At this time, the first transistor T2 and the driving transistor T1 are both turned off, and the light-emitting device LED does not emit light.

Figure 12:
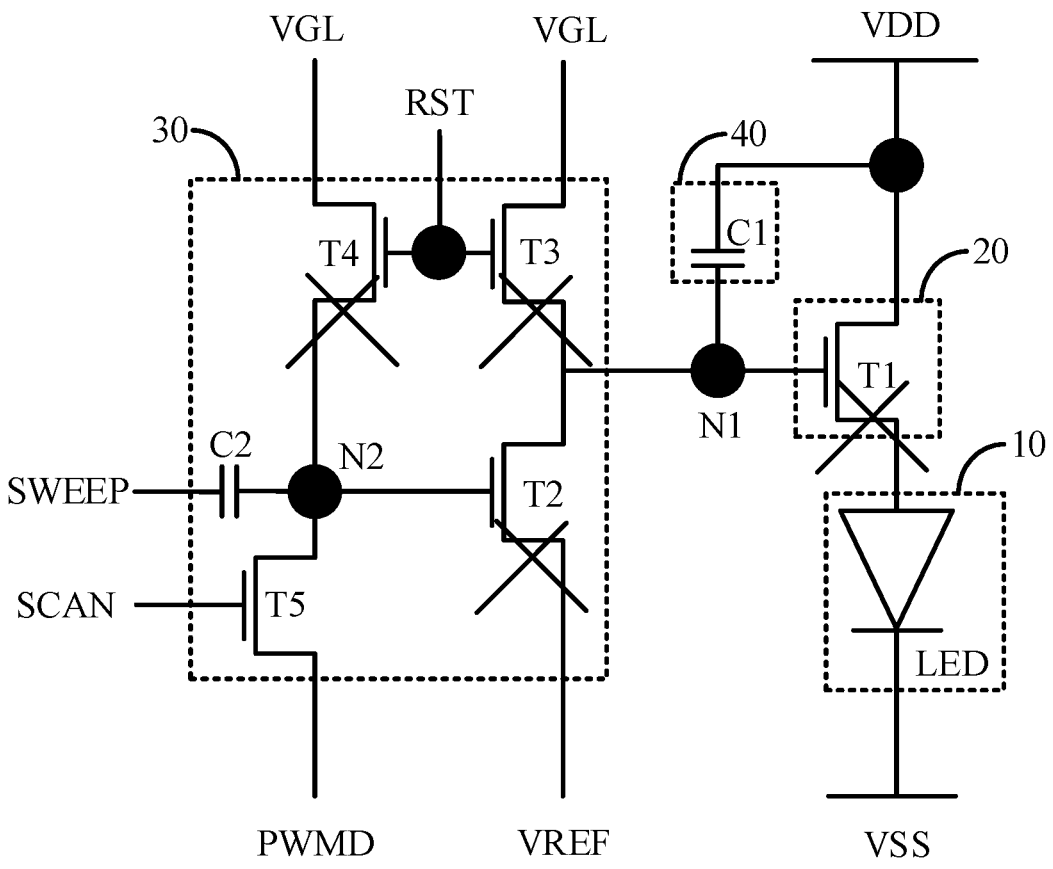
FIG. 12 is a circuit schematic diagram of the pixel circuit shown in FIG. 9 in a writing stage.

Row strobe stage T32: As shown in FIG. 12, the scan signal SCAN(N) is set to a high potential, both the third transistor T4 and the fourth transistor T3 are turned off, the second transistor T5 is turned on, and a potential of the second node N2 is a potential of the time controlling analog signal PWMD. At this time, a potential of the time controlling analog signal PWMD is less than a sum of a potential of the brightness control analog signal VREF and a threshold voltage of the first transistor T2, the first transistor T2 is turned off, and a potential of the first node N1 remain as a potential of the constant voltage low potential signal VGL, the driving transistor T1 is turned off, and the light-emitting device LED does not emit light. Among them, the scan signal SCAN (N−1) is a previous stage of the scan signal SCAN (N).

Figure 13:
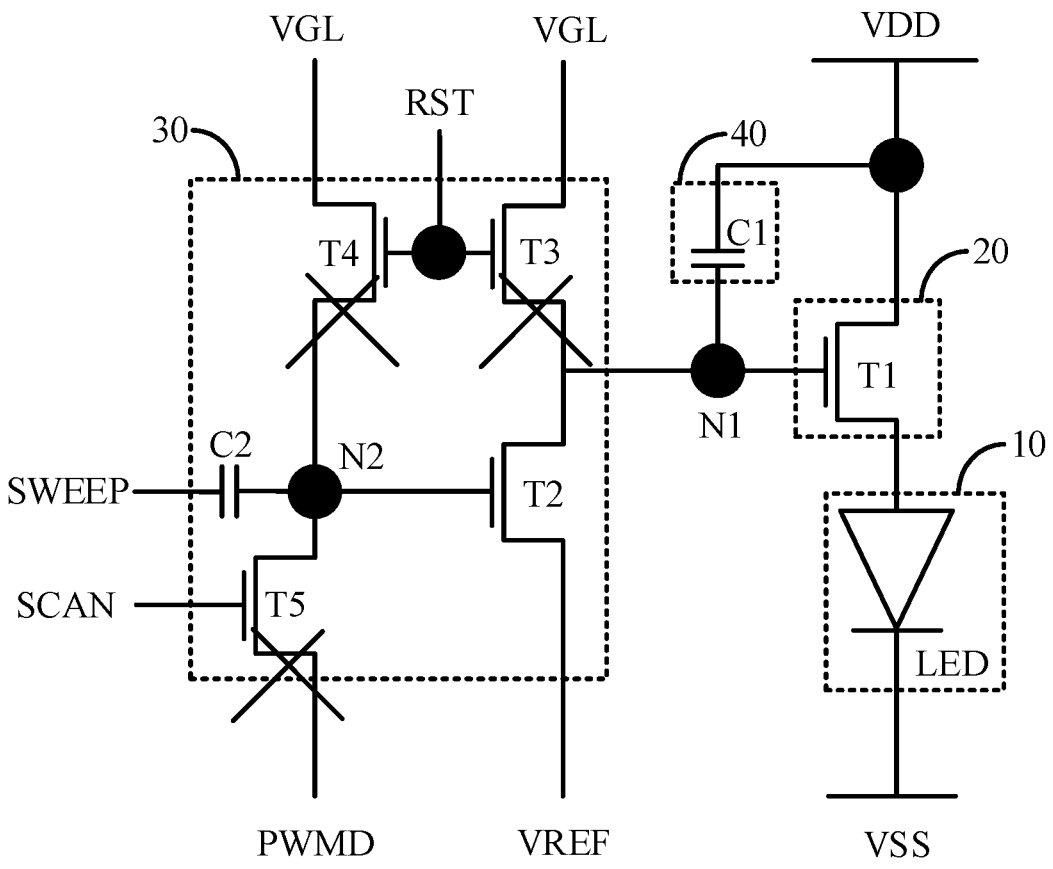
FIG. 13 is a circuit schematic diagram of the pixel circuit shown in FIG. 9 in a light-emitting stage.

Light-emitting stage T33: As shown in FIG. 13, the potential of the delta-wave analog signal SWEEP rises linearly. At this time, the potential of the second node N2 also rises linearly. When the potential of the second node N2 is greater than a sum of the potential of the brightness control analog signal VREF and the threshold voltage of the first transistor T2, the potential of the second node N2 is a sum of the potential of the brightness control analog signal VREF and potential variation ΔSWEEP of the delta-wave analog signal SWEEP, the first transistor T2 is turned on, and the potential of the brightness control analog signal VREF is applied to the first node N1, the light-emitting device LED starts to emit light, and the light-emitting current Id of the light-emitting device LED is as follows:

$$Id = \frac{1}{2} \times \mu_p \times Cox \times \frac{W}{L} \times (VREF - VSS - Vth1)^2$$

In the above formula, VSS refers to a potential of the negative signal of the power supply, VREF refers to a potential of the brightness control analog signal, and Vth1 refers to a threshold voltage of the driving transistor T1.

As shown in FIG. 5 or FIG. 10, in one of the embodiments, in one frame time, conduction time of the second transistor T5 is earlier than a conduction time of the first transistor T2, and a conduction state of the second transistor T5 is in a different time period from a conduction state of the first transistor T2.

In one of the embodiments, a conduction time of the driving module 20 is later than or equal to a conduction time of the first transistor T2.

In one of the embodiments, at least one of the potential of the time controlling analog signal PWMD and the brightness control analog signal VREF is kept constant. It is understandable that at least one of the time controlling analog signal PWMD and the brightness control analog signal VREF is able to set to a direct current signal, and it is not needed to be set to a higher frequency clock signal, not only can reduce a power consumption of the pixel circuit, but also realize a multi-gray-scale display of pixels.

In one of the embodiments, this embodiment provides a display panel, the display panel includes at least one pixel circuit in any of the above embodiments, and the pixel circuit is distributed in an array on the display panel.

The pixel circuit provided in this embodiment, the analog comparator 30 controls the conduction time of the driving module 20 through a connected triangle-wave analog signal SWEEP, a time controlling analog signal PWMD, and a brightness control analog signal VREF, thereby, a light-emitting time of the light-emitting module 10 is controlled. The conduction degree of the driving module 20 is controlled through the brightness control analog signal VREF connected to the analog comparator 30, thereby a brightness of the light-emitting module 10 is controlled, that is, by adjusting a light-emitting time and/or luminous brightness, a multi-gray-scale display is realized through a simpler pixel circuit structure.

Based on the above analysis, the pixel circuit shown in FIG. 4 or FIG. 9 does not require data signals in a traditional sense. Therefore, in this embodiment, the display panel does not need to be equipped with corresponding data drivers or data driving chips, which can reduce a cost of the display panel.

The foregoing embodiments are merely some embodiments of the present disclosure, and descriptions thereof are relatively specific and detailed. However, it should not be understood as a limitation to the patent scope of the present disclosure. It should be noted that a person of ordinary skill in the art may further make some variations and improvements without departing from the concept of the present disclosure, and the variations and improvements belong to the protection scope of the present disclosure. Therefore, the protection scope of the present disclosure shall be subject to the protection scope of the appended claims.

What is claimed is:

1. A pixel circuit, comprising:

a light-emitting module;

a driving module electrically connected to the light-emitting module; and an analog comparator, an output end of the analog comparator is electrically connected to a control end of the driving module, the analog comparator controls a conduction time of the driving module according to a triangle-wave analog signal, a time control analog signal, and a brightness control analog signal, and controls a conduction degree of the driving module according to the brightness control analog signal, wherein the analog comparator comprises:

a first transistor, an output electrode of the first transistor is electrically connected to the control end of the driving module, an input electrode of the first transistor is connected to the brightness control analog signal;

a second transistor, an output electrode of the second transistor is electrically connected to a gate electrode of the first transistor, an input electrode of the second transistor is connected to the time control analog signal, and a gate electrode of the second transistor is connected to a control signal; and a first capacitor, one end of the first capacitor is connected to a triangle-wave analog signal, and another end of the first capacitor is electrically connected to the output electrode of the second transistor.

2. The pixel circuit in claim 1, wherein in one frame time, a conduction time of the second transistor is earlier than a conduction time of the first transistor, and a conduction time state of the second transistor is in a different time period from a conduction time of the first transistor.

3. The pixel circuit in claim 2, wherein a conduction time of the driving module is later than or equal to the conduction time of the first transistor.

4. The pixel circuit in claim 1, wherein the analog comparator further comprises:

a third transistor, an input electrode of the third transistor is connected to a constant voltage signal, a gate electrode of the third transistor is connected to a reset signal, and an output electrode of the third transistor is electrically connected to the output electrode of the second transistor; and a fourth transistor, an input electrode of the fourth transistor is electrically connected to the input electrode of the third transistor, a gate electrode of the fourth transistor is electrically connected to the gate electrode of the third transistor, and an output electrode of the fourth transistor is electrically connected to the output electrode of the first transistor.

5. The pixel circuit in claim 4, wherein the driving module comprises:

a driving transistor, a gate electrode of the driving transistor is electrically connected to the output electrode of the first transistor, and an input electrode of the driving transistor or an output electrode of the driving transistor is electrically connected to the light-emitting module.

6. The pixel circuit in claim 5, wherein the first transistor, the second transistor, the third transistor, the fourth transistor, and the driving transistor are all P-channel thin film transistors; the constant voltage signal is a constant voltage high potential signal; during a light-emitting phase of the pixel circuit, a potential of the triangle-wave analog signal linearly changes from a high potential to a low potential.

7. The pixel circuit in claim 5, wherein the first transistor, the second transistor, the third transistor, the fourth transistor, and the driving transistor are all N-channel thin film transistors; the constant voltage signal is a constant voltage low potential signal; during a light-emitting phase of the pixel circuit, a potential of the triangle-wave analog signal linearly changes from a low potential to a high potential.

8. The pixel circuit in claim 1, wherein at least one of a potential of the time control analog signal and a potential of the brightness control analog signal is kept constant.

9. The pixel circuit in claim 8, wherein the pixel circuit further comprises:

a first wiring used for transmitting a power source positive signal;

a second wiring used for transmitting a power source negative signal; and a memory module, one end of the memory module is electrically connected to the control end of the driving module, and another end of the memory module is electrically connected to the first wiring or the second wiring.

10. The pixel circuit in claim 9, wherein the first wiring is electrically connected to another end of the memory module and an input end of the driving module, an output end of the light-emitting module is electrically connected to the input end of the driving module, and the output end of the light-emitting module is electrically connected to the second wiring; or the first wiring is electrically connected to an input end of the light-emitting module, the output end of the light-emitting module is electrically connected to the input end of the driving module, and the second wiring is electrically connected to the output end of the driving module and another end of the memory module.

11. A display panel, comprising:

at least one pixel circuit, and wherein the pixel circuit is distributed in an array on the display panel, wherein the pixel circuit comprising:

a light-emitting module;

a driving module electrically connected to the light-emitting module; and an analog comparator, an output end of the analog comparator is electrically connected to a control end of the driving module, the analog comparator controls a conduction time of the driving module according to a triangle-wave analog signal, a time control analog signal, and a brightness control analog signal, and controls a conduction degree of the driving module according to the brightness control analog signal, wherein the analog comparator comprises:

a first transistor, an output electrode of the first transistor is electrically connected to the control end of the driving module, an input electrode of the first transistor is connected to the brightness control analog signal;

a second transistor, an output electrode of the second transistor is electrically connected to a gate electrode of the first transistor, an input electrode of the second transistor is connected to the time control analog signal, and a gate electrode of the second transistor is connected to a control signal; and a first capacitor, one end of the first capacitor is connected to a triangle-wave analog signal, and another end of the first capacitor is electrically connected to the output electrode of the second transistor.

12. The display panel in claim 11, wherein in one frame time, a conduction time of the second transistor is earlier than a conduction time of the first transistor, and a conduction time state of the second transistor is in a different time period from a conduction time of the first transistor.

13. The display panel in claim 12, wherein a conduction time of the driving module is later than or equal to a conduction time of the first transistor.

14. The display panel in claim 11, wherein the analog comparator further comprises:

a third transistor, an input electrode of the third transistor is connected to a constant voltage signal, a gate electrode of the third transistor is connected to a reset signal, and an output electrode of the third transistor is electrically connected to the output electrode of the second transistor; and a fourth transistor, an input electrode of the fourth transistor is electrically connected to the input electrode of the third transistor, a gate electrode of the fourth transistor is electrically connected to the gate electrode of the third transistor, and an output electrode of the fourth transistor is electrically connected to the output electrode of the first transistor.

15. The display panel in claim 14, wherein the driving module comprises:

a driving transistor, a gate electrode of the driving transistor is electrically connected to the output electrode of the first transistor, and an input electrode of the driving transistor or an output electrode of the driving transistor is electrically connected to the light-emitting module.

16. The display panel in claim 15, wherein the first transistor, the second transistor, the third transistor, the fourth transistor, and the driving transistor are all P-channel thin film transistors, the constant voltage signal is a constant voltage high potential signal; during a light-emitting phase of the pixel circuit, a potential of the triangle-wave analog signal linearly changes from a high potential to a low potential.

17. The display panel in claim 15, wherein the first transistor, the second transistor, the third transistor, the fourth transistor, and the driving transistor are all N-channel thin film transistors, the constant voltage signal is a constant voltage low potential signal; during a light-emitting phase of the pixel circuit, a potential of the triangle-wave analog signal linearly changes from a low potential to a high potential.

18. The display panel in claim 11, wherein at least one of the potential of the time control analog signal and the potential of the brightness control analog signal is kept constant.

19. The display panel in claim 18, wherein the pixel circuit further comprises:

a first wiring used for transmitting a power source positive signal;

a second wiring used for transmitting a power source negative signal; and a memory module, one end of the memory module is electrically connected to the control end of the driving module, and another end of the memory module is electrically connected to the first wiring or the second wiring.

20. The display panel in claim 19, wherein the first wiring is electrically connected to another end of the memory module and an input end of the driving module, an output end of the light-emitting module is electrically connected to the input end of the driving module, and the output end of the light-emitting module is electrically connected to the second wiring; or the first wiring is electrically connected to an input end of the light-emitting module, the output end of the light-emitting module is electrically connected to the input end of the driving module, and the second wiring is electrically connected to the output end of the driving module and another end of the memory module.

* * * * *